United States Patent [19]

Downes

[11] 4,391,019

[45] Jul. 5, 1983

[54] CORNER CONNECTOR FOR SLIDING DOORS

[75] Inventor: Peter B. Downes, Oakville, Canada

[73] Assignee: DSH, Concord, Canada

[21] Appl. No.: 239,147

[22] Filed: Feb. 27, 1981

[51] Int. Cl.[3] ..... A47H 15/00; E05D 13/02

[52] U.S. Cl. ..... 16/105

[58] Field of Search ..... 16/105, 87 R, 97

[56] References Cited

U.S. PATENT DOCUMENTS

| | | | |
|---|---|---|---|
| 343,994 | 6/1886 | Ives | 16/105 |
| 2,680,875 | 6/1954 | Coffey | 16/105 |
| 3,813,728 | 6/1974 | Johnson | 16/105 X |
| 3,829,930 | 8/1974 | McNinch | 16/105 |

FOREIGN PATENT DOCUMENTS

| | | |
|---|---|---|
| 660588 | 4/1963 | Canada . |
| 744178 | 10/1966 | Canada . |
| 844876 | 6/1970 | Canada . |

*Primary Examiner*—Paul A. Bell

*Attorney, Agent, or Firm*—Ridout & Maybee

[57] ABSTRACT

Corner connectors for sliding doors which connect stiles and rails of the doors and carry upper and lower guide arms are improved by making the arms detachable. The arms are connected to the connector bodies by T-bars passing through T- or L-slots in the same so that the latter may be removed from the bodies at one end of their travel. The modified connectors are simpler to manufacture and reduce assembly and inventory problems.

7 Claims, 4 Drawing Figures

CORNER CONNECTOR FOR SLIDING DOORS

FIELD OF THE INVENTION

This invention relates to corner connectors for sliding door panels.

BACKGROUND OF THE INVENTION AND PRIOR ART STATEMENT

In a widely used form of sliding door used for closets and other fairly light-duty applications, the door is formed by a relatively thin panel of hardboard or similar material, with a suitable decorative facing, or by a mirror, to the edges of which are applied metallic stiles and rails linked by top and bottom corner connectors which also support and guide the door for sliding movement along top and bottom tracks fixed in a door opening. The top connectors have upwardly projecting arms carrying rollers which suspend the door from the upper rail, whilst the bottom connectors have downwardly projecting arms terminating in guide members which engage the lower rail and maintain the door in the desired plane whilst accommodating some degree of irregularity in the vertical spacing of the top and bottom tracks.

Progressively improved versions of such corner connectors are described in detail in Canadian Pat. Nos. 660,588 (Brydoff), 744,178 (Brydoff et al) and 844,876 (Kellems). The structures of the last of these patents not only links the stiles and rails, but also draws them together during assembly and largely eliminates the need for screws, rivets or other separate fastenings to secure the parts together.

Whilst the connector of the Kellems Canadian Pat. No. 844,876 has a number of advantages and performs very satisfactorily in many respects, I have sought to produce a connector which whilst retaining these advantages is simpler and cheaper in construction, and which avoids the causes of certain manufacturing and assembly problems which have arisen in practice with the prior art connector.

As is apparent from the Kellems patent, a single door panel requires four different corner connectors. It would clearly be an advantage to reduce this number of different parts.

Although the arms of the bottom connectors can be retracted for transportation of an assembled door, this is not the case for the suspension arms of the upper connectors. It has been found, particularly with mirror panels, that the projecting arms can easily be knocked during transit and damage or break the panel because of the leverage they exert. If a suspension arm or guide is damaged, the entire corner connector must be replaced, and care must be taken to obtain a correctly "handed" replacement connector. The guides and suspension arms are located by means of rivets passing through slots. The rivets must permit free sliding movement of the parts without excessive play. It is difficult to obtain adequate control during manufacture of the rivets and the riveting step to ensure a correct fit, resulting in a significant proportion of reject connectors which must be identified and reworked or discarded. If an unduly stiff connector escapes detection and is assembled into a door, the defect may well not come to light until the door is installed and fails to operate properly. If upon installation of a door, it turns out that a connector is damaged or defective a replacement must be obtained and installed, resulting in substantial delay and expense if the required part is not to hand. It also requires some skill to remove and refit a connector without damage to the adjacent components. Whilst I have referred above to the the Kellems patent as a convenient means of setting forth the prior art, it should be understood that similar connectors are already available on the market incorporating advances beyond the Kellems structure. Thus the Kellems patents is directed to a connector which is locked in situ by a spring detent which snaps into an opening in the stile. In practice it is found that the spring detent sometimes malfunctions, since the body of the connector is formed for reasons of economics and workability of a grade of steel which has limited elasticity. Consequently, if the detent is deflected more than usual for any reason, it can become permanently bent and fail to operate properly. Reliable results can be obtained without using the Kellems invention by employing a fixed projection on the bracket and relying upon the elasticity of the stile to provide the desired detenting action. Likewise the guide members to which the Brydoff Pat. No. 744,178 are directed, which are also utilized in the Kellems patent and which have two laterally offset feet, need not be used. I find that by using feet which are one behind the other without lateral offset, the feet may be made wider, they tend to support each other when deflected, and they are both satsifactorily retained in the track and easily removed from it when required.

SUMMARY OF THE INVENTION

The object of the present invention is to improve further upon the connectors discussed above, by rendering the connectors easier to manufacture whilst reducing rejects by reducing the inventory of different assemblies required to be stocked, by reducing the risk of damage of assembled doors during transit, and by simplifying repair when damage or malfunction does occur.

Accordingly, the invention provides, in a corner connector for a door slidable along top and bottom tracks, said connector comprising a rigid connector member unitarily formed with portions for locking engagement with a vertical stile and a horizontal rail of such a door whereby to hold them together, and an elongated arm movable vertically within said connector member whereby to control the extension of the distal end of said arm beyond the connector member, said distal end having a track engaging guide member, the connector member having portions forming a guide for vertical movement of said arm, the improvement wherein the arm is separable from the connector member, one of the connector member and the arm having a slot with vertically and laterally extending portions and the other of the connector member and the arm having a projecting stem and a cross piece supported by the stem, the stem extending through vertically extending portion of the slot and being retained therein by the cross piece through the normal range of relative movement of the arm and connector member, and the cross piece being withdrawable through the laterally extending portion of the slot at one extreme of said relative movement outside said normal range. The guide member may be a supporting roller or a guide foot depending on whether the connector is for the top or the bottom of the door. In a preferred embodiment the stem and cross piece are formed on the connector member by bending out a T-shaped tongue, and the cross piece of the tongue is bent over again parallel the plane of the door so that its spacing from the connector may be precisely controlled to guide the arm without either binding or excessive play. Whilst a T-shaped stem and cross piece and a T- or L-shaped slot are preferred, other suitably cooperating configurations are possible.

The arms may be shipped separately from the connector members, both before and after incorporation into a door. Although "handed" connector members will still be required, all requirements for a door may be met by just two connector members and two arms, rather than the four different connector member/arm assemblies previously required. The assembled doors may be shipped without the arms in place, thus avoiding risk of damage either to the arms or the doors, and providing a unit which is free from inconvenient projections at its corners. In the event of damage to an arm, it is not necessary to change the entire corner connector and thus disturb the structure of the door: instead just the arm can readily be replaced in an operation which requires little skill and no special tools. Production of the connectors is cheaper since both the rivet and the assembly operation required to install the rivet are eliminated, together with the rejects caused by the inaccuracies associated with the riveting operation.

The invention is described further with reference to the accompanying drawings, wherein.

Figure 1:
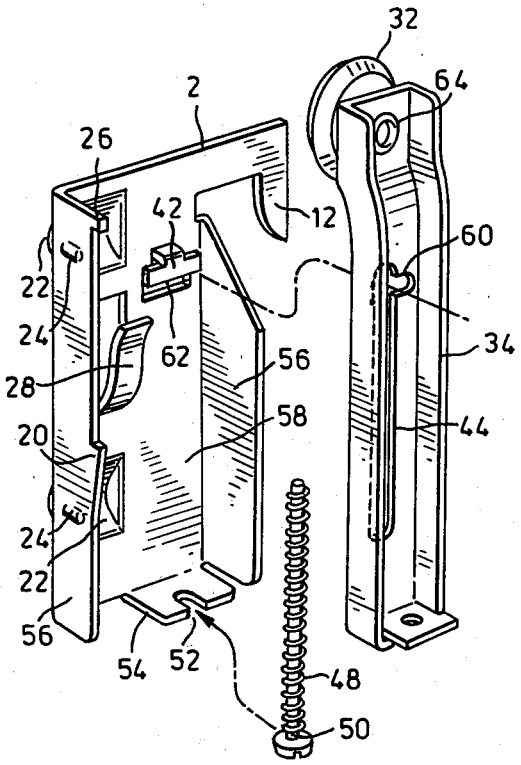
FIG. 1 is an exploded perspective view of a top connector.
Figure 2:
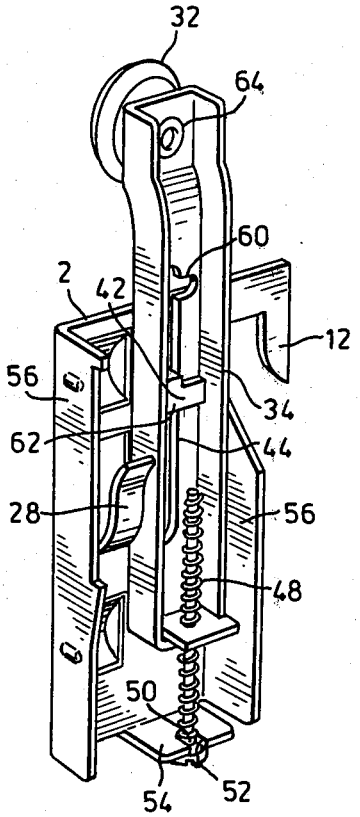
FIG. 2 is an assembled perspective view of the same connector.

Referring to the drawings, the corner connectors shown function to connect the components of a sliding door and to support that door on upper and lower tracks in very much the same general manner as in the prior art as discussed above, and thus these aspects of the connectors will not be described in great detail.

Figure 3:
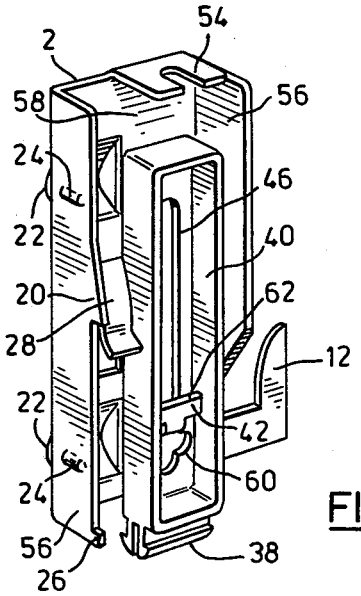
FIG. 3 is a perspective view of a bottom connector.
Figure 4:
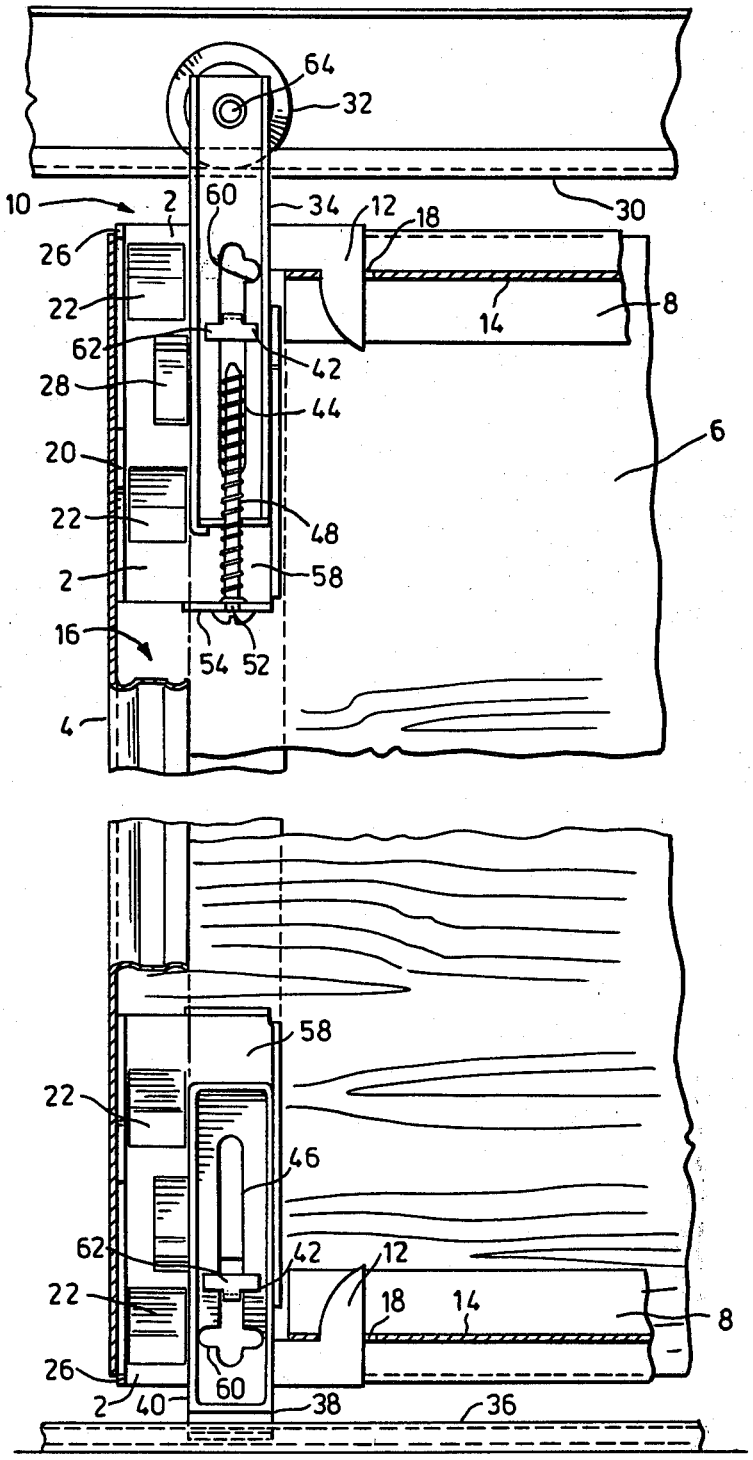
FIG. 4 is a fragmentary rear elevation of portions of a sliding door system showing top and bottom connectors in situ.

The four connectors required to assemble a door each comprise a connector member 2 as best seen in FIG. 1. Two of these connector members will be exactly as shown in FIG. 1, whilst two will be mirror images as shown in FIG. 3 and the lower part of FIG. 4. One type of connector member is used at the top right hand and bottom left hand of the door, and the other type at the other two corners. The stiles 4 of the door are formed by E-section rails having two channels, the first one of which is pressed on to the vertical edges of a panel 6 which is typically of hardboard or a mirror. The top and bottom rails 8 of the door are of channel section with a rearwardly projecting flange 14, the channel sections being pressed onto the top and bottom edges of the panel 6. One side 10 of a connector member is pressed into each end of the rearward channel 16 of the stiles 4 so that the tongue 12 on its opposite side enters an aperture 18 cut in the flange 14 of a rail 8 and draws the rail into abutment with the stile. The side 10 of the connector member is retained in the stile against lateral movement by appropriate configuration of the channel, and against vertical movement by engagement of a projection 20 with a slot cut in the channel 16. The stile section is sufficiently resilient to allow the projection to pass along the channel and pop into the aperture when the connector member is fully inserted. Location of the connector member in the channel is assisted by various projections 22, 24, 26 formed thereon, and retention of the connector may be further assured, if desired, even in the absence of a slot to receive projection 20, by a screw driven through the stile and an aperture in the connector to engage a tongue 28.

The assembled door when in use is guided and supported on a top track 30 by rollers 32, at the distal ends of upper arms 34 and further guided in a bottom track 36 by feet 38 at the distal ends of lower arms 40, the arms 34 and 40 being detachable from the connector members 2. If an assembled door is to be transported or stored prior to installation, it is preferred that the arms are fitted later as part of the installation process. This avoids awkward projections from the doors and substantially reduces the risk of damage to the doors or the arms as well as rendering the doors easier and more compact to handle and store.

Connection between the connector members and the arms is achieved by means of T-arms 42 engaging slots 44 and 46. Although in the embodiments shown, The T-arms are formed on the connector members and the slots in the arms, it will be understood that the opposite arrangement could be used. In use, the vertical relationship of the upper arms 34 relative to their associated connector members 2 is adjusted in known manner by means of adjusting screws 48 having necks 50 restrained against vertical but not rotational movement by engagement with slots 52 in end walls 54 of the connector members. The lower arms 40 are allowed to move vertically relative to the connector members 2 to allow for irregularities in the distance between the upper and lower tracks 30 and 36 without interfering with lateral movement of the feet 38 in the guide 36.

The connector members 2 define guides for movement of the arms 34 and 40, these guides being defined by side walls 56 and bottom walls 58 as well as the tongue 28, maximum movement into the guide being determined by the end walls 54. Further guidance is provided by engagement of the T-arms 42 with the slots 44 and 46, and in the case of the upper arms, by the engagement of the screws 48 with the slots 52. Cross pieces 60 of the slots are positioned so that they will be adjacent the cross pieces 62 of the T-arms only when the arms are in an extreme position which they will never assume during normal use of the door. Conveniently this is with the arms in their innermost possible position since the arms may be brought to this position with the door in situ. The arms 34 are conveniently metal pressings with the rollers 32 journalled on rivets 64, whilst the less heavily stressed lower arms 40 may be moulded from a synthetic plastics material such as nylon, integrally with the feet 38. The thickness of both types of arm adjacent the slots should be the same so that they will interengage with the T-bars 42 on the connector members, but otherwise they may be the same as prior art arms other than for the presence of the cross portions 60 of their slots.

The T-bars 42 may be formed by pressing out a T-shaped tongue from the metal of the connector 2, and bending over the cross piece 62 of the T-shaped tongue. This bending fulfills two functions. It increases the area of contact between the T-bar and the arms 34 and 40 adjacent their slots, and it enables the spacing between the cross piece 42 and the bottom wall 58 of the connector body to be precisely controlled during manufacture merely by the insertion of an appropriately dimensioned stop member beneath the cross piece during the bending operation. This in turn means that a desired fit without either tightness or excessive play can readily be assured between the arms and the bodies when these are fitted during installation of a door. If any fit problem does arise, it can readily be corrected by bending the T-bar slightly.

To fit an upper arm 34, the screw 48 is removed and the arms maneuvered into the connector body so that one end of the cross piece 62 of the T-bar 42 passes through the vertically extending portion of the slot and the other end is then passed through the laterally extending portion 60 of the slot 44. The arm is then moved upwardly to allow the screw 48 to be re-inserted and the neck 50 of the screw to enter the slot 52. The screw is then turned to move the arm so that the roller 32 is at a height such that the door will hang correctly from the track 30. If the portion 60 extends to both sides of the slot the arm may be inserted without removal of the screw, but there is then some risk of the arm being inadvertently moved to an extreme position in which the T-bar disengages from the slot. To fit the lower arms 40, the arms are merely inserted in the connector bodies so that the cross pieces 62 move through the cross pieces 60 and they are then moved downwardly until the feet 38 can be pressed into a top opening of the track 36.

Since these fitting operations are no more than modifications of steps already required during installation of prior art doors, no significant additional time is required to install the door. On the other hand, several problems associated with prior art connectors are eliminated, and the cost of manufacturing and stocking the connectors is reduced. The formation of the T-bars 42 is readily incorporated into the sequence of pressing operations already required to form the connector members used in prior art connectors, whilst the alterations required in the arm pressings and mouldings are minimal. On the other hand the rivet and riveting operation previously required is eliminated, together with its attendant problems, whilst assembly of the doors is simplified and the likelihood of defective doors is reduced. If defects should occur, they are more easily rectified.

What I claim is:

1. In a corner connector for a sliding door slidable along top and bottom tracks, said connector comprising a rigid connector member for locking engagement with a vertical stile and a horizontal rail of such a door whereby to hold them together, and an elongated arm movable vertically within said connector member whereby to control the extension of the distal end of said arm beyond the connector member, said distal end having a track engaging guide member, the connector member being a one-piece stamping formed from metal sheet, the general plane of which is located when in use in a vertical plane behind and parallel to a panel of the door, said connector member including a portion at one vertical margin bent rearwardly out of the general plane of the sheet and configured for locking engagement with the stile and a portion at an opposite vertical margin configured for engagement with a slot in the rail, the arm being supported for vertical sliding movement in contact with the rear surface of the sheet, the improvement wherein the arm is separable from the connector member, and is normally guided longitudinally and retained in contact with the rear surface of the sheet solely by a plurality of portions of the sheet struck rearwardly out of the plane of the sheet and presenting guiding and retaining surfaces to the arm which restrict it to vertical sliding movement in contact with the rear surface of the connector throughout its normal range of movement, the rearwardly struck portions being so located and configured relative to the location and configuration of the arm that the latter can be disengaged therefrom but only when moved vertically to a position beyond one end of its normal range of movement.

2. A corner connector according to claim 1, wherein the rearwardly struck portions of the connector member include such a portion which firstly extends rearwardly and has surfaces restraining the arm against lateral movement, and thereafter extends laterally forming a crosspiece having a surface restraining the arm against movement away from the rear surface of the connector.

3. A corner connector according to claim 2, the arm having a slot with vertically and laterally extending portions and the connector member having a rearwardly struck portion defining a projecting stem and a cross piece supported by the stem, the stem extending through vertically extending portion of the slot and having retained therein by the cross piece through the normal range of relative movement of the arm and connector member, and the cross piece being withdrawable through the laterally extending portion of the slot at one extreme of said relative movement outside said normal range.

4. A corner connector according to claim 3, wherein the guide member is a supporting roller, and the arm is further separably attachable to the connector member by an adjusting screw engaged with the arm and engageable with a further slot formed in the connector member.

5. A corner connector according to claim 4, wherein the vertically and laterally extending slot in the arm has an L-shape, through which the cross piece on the connector member is maneuverable only after removal of the screw.

6. A corner connector according to claim 3, wherein the guide member is a guide foot moulded integrally with the arm, and the slot is a T-shaped slot formed in the arm.

7. A corner connector according to claim 1, 5 or 6, wherein the stem and cross piece are formed on the connector member by a T-shaped tongue bent out from a wall of the connector member, and the cross piece of the tongue is bent over again parallel with the plane of said wall of the connector member to form the cross piece.

* * * * *